US008216404B1

(12) United States Patent
Singh et al.

(10) Patent No.: US 8,216,404 B1
(45) Date of Patent: Jul. 10, 2012

(54) PROCESS FOR CRYSTALLINE EXPLOSIVES CONTAINING HALOGENATED WAX BINDERS

(75) Inventors: Sanjeev K. Singh, Dover, NJ (US); Philip Samuels, Manville, NJ (US); Christos Capellos, Morris Plains, NJ (US); Barry Fishburn, Dover, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/013,008

(22) Filed: Jan. 25, 2011

Related U.S. Application Data

(62) Division of application No. 12/401,061, filed on Mar. 10, 2009, now Pat. No. 7,955,452.

(51) Int. Cl.

| | |
|---|---|
| ***D03D 23/00*** | (2006.01) |
| ***C06B 45/18*** | (2006.01) |
| ***C06B 45/20*** | (2006.01) |

(52) U.S. Cl. ..... 149/109.6; 149/3; 149/9

(58) Field of Classification Search ..... 149/3, 9, 149/11

See application file for complete search history.

(56) References Cited

U.S. PATENT DOCUMENTS 5,552,000 A * 9/1996 Shepherd, Jr. ..... 149/2

* cited by examiner

*Primary Examiner* — Aileen B Felton

(74) *Attorney, Agent, or Firm* — Henry S. Goldfine

(57) ABSTRACT

A process for manufacture of explosive formulations containing a halogenated wax binder, involving dilution of the halogenated wax in a non-aqueous lacquer, slurring the explosive in an aqueous solution and applying heat and vacuum to yield a granular explosive which provides complete coating to avoid hot spots and is quickly pressable at lower temperature and pressure.

1 Claim, No Drawings

PROCESS FOR CRYSTALLINE EXPLOSIVES CONTAINING HALOGENATED WAX BINDERS

CROSS-REFERENCE TO RELATED APPLICATIONS

This application is a divisional application of currently U.S. patent application Ser. No. 12/401,061, filed Mar. 10, 2009, now U.S. Pat. No. 7,955,452 which application is hereby incorporated herein in its entirety by reference.

STATEMENT OF GOVERNMENT INTEREST

The invention described herein may be licensed, manufactured, and used by or for the Government of the United States of America, for government purposes, without the payment of any royalty.

BACKGROUND OF THE INVENTION

1. Field of the Invention

The present invention relates to explosive formulations containing halogenated wax binder systems and process for production thereof, the process involving dilution of the halogenated wax in a non-aqueous lacquer, slurring fine and very fine particle size crystalline explosive in an aqueous solution, adding the lacquer, distilling off the solvent, vacuum filtering and drying to yield a granular explosive which provides complete coating to avoid hot spots and is easily pressable at lower temperature and pressure.

2. Discussion of the Prior Art

Newer munitions are designed to minimize any violent (explosive) response when subjected unintended stimuli during transportation, storage, or because of enemy action. It is also critical that such Insensitive Munitions (IM) not sacrifice necessary explosive efficiency of the conventional munitions they replace.

Denser explosives generally yield higher detonation velocities and pressures, i.e. greater explosive efficiency. Particularly high efficiency explosives that are chemically stable and relatively safe to handle are aliphatic nitramines, including cyclotetramethylenetetranitramine, HMX, and cyclotrimethylenetrinitramine, RDX. HMX is an efficient explosive, having a detonation velocity above 9,000 m/sec. (at a density of 1.9); RDX exhibits a detonation velocity of 8,400 m/sec. (at a density of 1.7); while TNT exhibits a detonation velocity of 6,940 m/sec. (at a density of 1.62).

TNT has a melting point of 80° C., such that it can be cast or easily pressed into the desired shape. It contrast, HMX has a melt point of 282° C. and RDX has a melt point of 203° C., such that these explosives would decompose if cast. Further, it has long been known that crystalline organic detonating compounds such as RDX, and HMX, must be treated with an additive to impart to them the characteristics required for handling and processing. When untreated, the discrete particles comprising these materials generally have poor flowing properties which tend to make the particles bridge deleteriously during their introduction into munitions. Furthermore, due to the lack of cohesive forces among these discrete particles, the plain or untreated, RDX or HMX cannot be pressed into pellets or the like, for example those used in shape charges, of sufficient coherency to maintain their form when removed from the die or when subjected to the usual mechanical stresses incurred in handling.

To provide the necessary free-flowing properties, crystalline organic explosives are usually treated with a graining agent, i.e. an additive imparting free flow, which coats and lubricates the larger grains and agglomerates the finer crystals. Numerous graining agents are known, including graphite, wax, gums, shellacs, polyvinyl alcohol, and a variety of plastics and resins. In many instances these graining agents act also as binders which facilitate the forming of the crystalline explosive into a coherent mass. One particular pressed explosive charge is disclosed in U.S. Pat. No. 3,291,666, which discloses admixing a copolymer of vinylidene fluoride and hexafluoropropylene with the crystalline explosive to obtain a free flowing, readily pressable composition. A second pressable explosive is disclosed in U.S. Pat. No. 5,547,526, which discloses a pressed plastic bonded explosive that is pressed under a pressure of 1000 bar (~14,500 psi) or higher.

As stated above, explosive formulations may contain wax binders, such as the combination of carnauba max and ozokerite wax disclosed in U.S. Pat. No. 6,641,683. Such wax binder based formulations provide a matrix which can accept reactive metals to enhance the heat of reaction, while being cost effective, and easily loaded using high speed presses. Further, such wax binders phlegmatize, i.e. stabilize or desensitize, the explosive formulation, as the wax tends to fill in gaps between explosive grains, lowering the probability of unintended initiation, i.e. lowering the sensitivity. The extent of sensitivity reduction generally relates to the amount of wax included in the formulation. However, addition of wax strongly reduces explosive performance, again in proportion to the amount of wax added. Thus, there is a tradeoff between increasing the amount of wax to obtain better insensitivity with reduced performance and decreasing the wax to gain higher power at the cost of becoming more sensitive.

In December 2006, at the Joint Army, Navy and Air Force (JANNAF) 41$^{st}$ CS129$^{th}$ APS/23$^{rd}$ PSHS, in San Diego. P. Samuels, S. Singh, and B. Fishburn, disclosed use of halogenated wax binder systems in high power explosives. A developmental PAX-46 explosive was disclosed, containing 91.5% bi-modal RDX, 8.5% chlorinated wax and oil, i.e. a plasticizer. This RDX/chlorinated wax based explosive was disclosed to exceed the IM properties of LX-14, containing 95.5% HMX and 4.5% plastic binder system. PAX-46 was said to yield greater explosive efficiency than Composition A5, a RDX/stearic acid based explosive used in numerous munitions, including guided multiple launch rocked systems (GMLRS), 40-mm M430A1, assorted submunitions, small shaped charges and boosters. However, the December 2006 disclosure failed to disclose anything regarding the manufacture of PAX-46 or similar halogenated wax binder explosives; failed to disclosure anything specific about the binders system, e.g. other than usage of wax and oil combination, nothing was said about a particular solid/liquid binder system; failed to disclose anything about the particle size of the explosive material; failed to mention anything about hotspots; and with respect to flow properties, only mentioning that PAX-46 was durable to help in pressing, and had good flow properties.

U.S. Pat. No. 6,641,683, mentioned above, discloses a melt process for the manufacture of wax based explosive compositions, which results in a castable product. However, this process does not yield pressable granules amiable to modern high speed pressing into shaped charges, warhead explosives, or shell propellants. Also, the melt process of U.S. Pat. No. 6,641,683 subjects the composition to temperatures of from 84° C. to 820° C., which high temperatures can cause undesirable softening, agglomeration and potential degradation of the subject halogenated wax binder explosive, all of which will negatively effect its flow properties, if it were desired to attempt to press the resulting product into finished munitions.

U.S. Pat. No. 3,985,595 discloses a heat resistant symtriaminotrinitrobenzene (TATB) explosive composition that contains a halogenated plastic (i.e. fully saturated copolymer of chlorotrifluoroethylene and vinylidene fluoride) binder, which is manufactured by a known slurry process resulting in explosive beads, which beads form a moldable powder. This slurry process involves mixing powdered explosive and water in a kettle equipped with a condenser and agitator. A lacquer composed of the halogenated plastic is dissolved in a suitable solvent and added to the slurry. The solvent is removed by distillation, such as by use of a steam sparger, causing the plastic phase to participate out on the explosive. The resulting plastic-explosive agglomerates into "beads" as the stirring and solvent removal continues. The water is removed from the beads by filtration and drying, which drying is disclosed to be in a forced draft oven at 100° C. Unfortunately, this process, subjecting the composition repeatedly to elevated temperatures, such as with a steam sparger, giving localized temperatures well over 100° C., and subsequent 100° C. drying, can cause undesired softening and agglomeration of the subject halogenated wax binder explosive and as stated above, negatively impact its flow properties. Further, the U.S. Pat. No. 3,985,595 discloses a preference to reduce agitation during the solvent removal step, an act which is contraindicated with halogenated wax binder explosives due to a phase separation unique to such systems, as discussed below.

There is a need in the art for a halogenated wax binder explosive and means for manufacture thereof, the explosive having good flow properties and good pressability, required for modern munition high speed manufacturing, as well as, uniform coating to avoid hot spots.

SUMMARY OF THE INVENTION

Therefore, it is an object of the present invention to propose explosive compositions containing halogenated waxes and a process for manufacture thereof, which compositions are granular, free flowing, readily pressable, and uniform, to avoid any uncoated explosive which may cause unwanted hot spots. The process involves the following steps:

1. initially preparing a lacquer containing a halogenated wax binder system, by first heating about 85 to 87% by weight of a suitable solvent, to from about 30 to 50° C.; second, slowly adding about 10 to 11% by weight a powdered chlorinated wax; third, slowly adding about 3 to 4% by weight of a liquid chlorinated oil, and fourth, agitating the mixture at moderate agitation, about 350 rpm, for up to about 3 hours, to form a homogenous, storable, lacquer;
2. wetting about a 50:50 mixture of fine, about 250 to 450 micron, and very fine, about 2 to 6 micron, crystalline explosive, by adding the fine crystalline explosive to a water and solvent mixture, agitating at a moderate 400 to 500 rpm for about 15 to about 20 minutes, at a temperature of from about 60° C. to 70° C.—the weight percentage of very fine and fine crystalline explosive should be from about 13 to 15% of each, the weight percentage of solvent should be about 1 to 2%, and the weight percentage of water should be about 68 to 73%;
3. slowly add, at room temperature, about 10 to 15% by weight lacquer, to 85 to 90% by weight, 60° C. to 70° C. wetted crystalline explosive mixture under slow agitation, the lacquer should be introduced into the wetted crystalline explosive mixture at several different locations therein, to ensure that the lacquer is evenly distributed;
4. agitating the lacquer/wetted crystalline explosive mixture for about 20 to 40 minutes, at high agitation, about 500 to 700 rpm, thereby uniformly coating the crystalline explosive mixture with the lacquer;
5. polishing the lacquer coated crystalline explosive by adding ⅓ to ½ the quantity of water used in the wetting step, above, while continuing to agitate at about 400 to 600 rpm, for about 15 to 30 minutes;
6. distilling off the solvent at from about 82° C. to 95° C.;
7. cooling the resulting coated crystalline explosive slurry to about 50° C. and filter the slurry using a vacuum pump filter;
8. washing the resulting cooled, filtered, slurry with water;
9. oven drying the cooled, filtered, slurry at about 20° C. to 40° C. for a period of from about 8 to 16 hours, until constant weight is maintained and remove the finished wax coated crystalline explosive, moldable powder.

To obtain the desired moldable wax coated crystalline explosive powder it is essential that a halogenated solid wax/liquid oil binder system be used, and that about a 50:50 mixture of course and fine crystalline explosive be used. Specifically, it is preferable to use a Class III, 360 micron, fine RDX, and a Fluid Energy Milled (FEM), 4 micron, very fine RDX powder. Further, to ensure the necessary dispersion of the lacquer within the wetted crystalline explosive, the lacquer may be introduced via a multiport funnel, having 3 ports located 120 degrees apart, the ports at abut 90 degrees to the vertical, so that three streams are introduced into the wetted crystalline explosive at widely separated positions.

The resulting moldable wax coated crystalline explosive powder, the molding powder, can be molded with a dwell times as short as about two minutes, by heating the molding powder and die to about 65° C., and at low pressure, pressing at about 26,500 ft./lbs.

DETAILED DESCRIPTION OF THE INVENTION

The process or method as described herein, allows for the production of insensitive, thermally stable explosive charges containing high density chlorinated and fluorinated wax binders and common nitramines crystalline explosives, such as RDX and HMX. The method results in a moldable powder of chlorowax or halowax coated RDX or HMX or other crystalline explosive material, which are easily pressable into high quality charges, without hot spots.

The halogenated binders preferred in the present process are cheap and commercially available. Further, it has been found that using a solid/liquid combination of chlorowax and oil, and about a 50:50 mix of fine and very fine particle crystalline explosive results in an easily pressible, high quality explosive at nearly maximum density and without hot spots, i.e. an explosive greater than 98% theoretical maximum density, with very little variation). The pressiblity is shown by the fact that the resulting crystalline explosive can be pressed at low temperature and relatively low pressure, compared to a conventional, non-chlorowax explosive manufactured by conventional means.

Preferred solid/liquid halogenated binder systems include a combination of powdered Chlorez 700-SS, a chlorinated paraffin resin, and a liquid, Paroil 170T, a low viscosity, short chain chlorinated paraffin plasticizer, available from Dover Chemical Corporation, Dover, Ohio 44622-0040. It has been discovered that this preferred Chlorez 700-SS/Paroil 170T binder system when formulated into the required lacquer, to separate, with a white solid suspension settling to the bottom of the lacquer. Therefore, it is essential that after the lacquer is introduced into the wetting about a 50:50 mixture of fine and very fine crystalline explosive the resulting slurry be agitated at a high 500 to 700 rpm, preferably 650 rpm, for about 20 to 40 minutes, preferably about 30 minutes. An alternative, halogenated binder system includes a combination of powdered Halocarbon 2300 wax, and a liquid Halocarbon 27 oil, a medium molecular weight polymer of chlorotrifluoroethylene, available from Halocarbon Corporation, River Edge, N.J. 07661.

Suitable solvents for preparing a lacquer containing a halogenated wax binder include ethanol; iospropanol; a mixture of an alcohol, such as isopropanol, n-butanol, n-pentanol, and the like, and an ester, such as ethyl acetate, butyl acetate, and the like; or a ketone, such as methyl ethyl ketone (MEK), acetone, methyl isobutyl ketone (MIBK), and the like.

A preferred process to yield the granular, free flowing, readily pressable, and uniform crystalline explosive containing a chlorinated wax, is comprised of the following steps:

A. in a lacquer pot, preparing a lacquer containing a chlorinated wax, by first heating about 86% by weight of the solvent MEK, to about 40° C.; second, slowly adding about 10% by weight powdered Chlorez 700-SS chlorinated wax; third, slowly adding about 4% by weight liquid Paroil 170T, and fourth, agitating the mixture at about 350 rpm, for 3 hours, to form a homogenous, storable, lacquer;

B. wetting about a 50:50 mixture of about 12.5% by weight Class III RDX and about 12.5% by weight FEM RDX, by adding the RDX mixture, to a water/solvent mixture containing about 73% by weight water and about 2% by weight MEK, then adding the very fine crystalline explosive thereto, agitating at about 450 rpm for about 15 minutes, at a temperature of about 65° C., in a standard chemical reactor;

C. slowing add, at room temperature, about 12% by weight of the lacquer, to about 88% by weight of the 65° C. wetted crystalline explosive within the chemical reactor, under slow agitation, the lacquer should be introduced into the wetted crystalline explosive using a funnel with three ports, 120 degrees apart, which ports are at 90 degrees to the vertical, or through widely spaced feeds into the reactor, if the reactor is fitted with such ports;

D. agitating the lacquer/wetted crystalline explosive mixture for about 30 minutes, at about 650 rpm, to uniformly coat the crystalline explosive mixture with the lacquer;

E. polishing the lacquer coated crystalline explosive by adding about 40% of the quantity of water used in the wetting step, above, while continuing to agitate at about 500 rpm, for about 25 minutes;

F. in a standard still equipped with an impeller for mixing, distill off the solvent at about 88° C. and recover the MEK;

G. cooling the resulting coated crystalline explosive slurry to about 50° C. and filtering the slurry using a vacuum pump filter;

H. washing the resulting cooled, filtered, slurry with water;

I. oven drying the cooled, filtered, slurry at about 30° C. to for a period of about 12 hours, until constant weight is maintained and remove the finished wax coated crystalline explosive, moldable powder.

As stated above, the finished halogenated wax coated, crystalline explosive, molding powder and die to be used in pressing are heated to 65.6° C. and pressed performed at low pressure 26,500 ft./lbs. to produce pellets or other desired form. Pressing requires only one dwell of two minutes to achieve this quality of charge. As shown in Table I, below, the pressing conditions for molding an equivalent sample of PAX-46, a halogenated wax coated, crystalline explosive, manufactured in accord with the subject inventive process and LX-14, a moldable, but conventional crystalline explosive molding powder. The PAX-46 has a formulation of 45.5% by weight Class III RDX, 45.5% by weight FEM, 4.8 micron, RDX, 6.3% by weight Chlorez 700-SS Wax and 2.7% by weight Paroil 170T. In contrast, the LX-14 is a polymer-bonded crystalline HMX explosive, containing about 95% various classes of HMX and 5% Estane polymer. The LX-14 is manufactured by a conventional process, where the polymer is dissolved in a solvent, and mixed with the crystalline explosive. The solvent is then drawn off and a pressable granular product consisting of the explosive in the polymer binder is left.

TABLE I

| Parameter | LX-14 | PAX-46 |
|---|---|---|
| Press Load (ft./lbs.) | 40,000 | 26,500 |
| Temperature (° F.) | 210 | 150 |
| Cycle/Times | 1 min ON<br>30 sec OFF<br>1 min ON<br>30 sec OFF<br>1 min ON | 2 min |
| Theoretical Maximum Density (TMD) (%) | 98.5% | 99%+ |

As shown in Table I, the pressing of PAX-46, manufactured in accordance of the subject inventive process, only requires about 66% of the pressure, about 71% of the temperature and only 50% of the time versus that required for the conventional LX-14 crystalline explosive. Further, the PAX-46 produced has a significantly higher TMD percentage, which translates into greater relative explosive force.

What is claimed is:

1. A granular, free flowing, easily pressable, and uniformly coated crystalline explosive mixture prepared by the process comprising:

preparing a lacquer containing a halogenated wax binder, by first heating about 85 to 87% by weight of a suitable solvent, to from about 30 to 50° C.; second, slowly adding about 10 to 11% by weight a powdered chlorinated wax; third, slowly adding about 3 to 4% by weight of a liquid chlorinated oil, and fourth, agitating the mixture at moderate agitation, about 350 rpm, for up to about 3 hours, to form a homogenous, storable, lacquer;

wetting about a 50:50 mixture of fine, about 250 to 450 micron, and very fine, about 2 to 6 micron, crystalline explosive, by adding the fine crystalline explosive to a water and solvent mixture, then adding the very fine crystalline explosive thereto, agitating at about 400 to 500 rpm for about 15 to about 20 minutes, at a temperature of from about 60° C. to 70° C., the weight percentage of very fine and fine crystalline explosive being each from about 13 to 15%, the weight percentage of solvent being about 1 to 2%, and the weight percentage of water being about 68 to 73%;

slowing add, at room temperature, about 10 to 15% by weight lacquer, to 85 to 90% by weight, 60° C. to 70° C. wetted crystalline explosive mixture under slow agitation, the lacquer being introduced into the wetted crystalline explosive mixture at several different locations therein, whereby the lacquer is evenly distributed;

agitating the lacquer/wetted crystalline explosive mixture for about 20 to 40 minutes, at high agitation, about 500 to 700 rpm, thereby completely coating the crystalline explosive mixture with the lacquer;

polishing the lacquer coated crystalline explosive by adding ⅓ to ½ the quantity of water used in the wetting step, above, while continuing to agitate at about 400 to 600 rpm, for about 15 to 30 minutes;

distilling off the solvent at from about 82° C. to 95° C.;

cooling the resulting coated crystalline explosive slurry to about 50° C. and filter the slurry using a vacuum pump filter;

washing the resulting filtered slurry with water;

oven drying the filtered slurry at about 20° C. to 40° C. for a period of from about 8 to 16 hours, until constant weight is maintained and removing the finished wax coated crystalline explosive, moldable powder.

* * * * *